US007588152B2

(12) United States Patent
Law

(10) Patent No.: US 7,588,152 B2
(45) Date of Patent: Sep. 15, 2009

(54) ELECTRICAL CORD STORAGE SYSTEMS AND METHODS

(75) Inventor: Timothy David Law, Roswell, GA (US)

(73) Assignee: Tim Law, Roswell, GA (US)

( * ) Notice: Subject to any disclaimer, the term of this patent is extended or adjusted under 35 U.S.C. 154(b) by 401 days.

(21) Appl. No.: 11/121,678

(22) Filed: May 4, 2005

(65) Prior Publication Data

US 2006/0249425 A1 Nov. 9, 2006

(51) Int. Cl.
*A47F 7/00* (2006.01)

(52) U.S. Cl. ..... 211/26.2

(58) Field of Classification Search ..... 211/70.6, 211/26.2, 87.01; 206/701, 702, 372, 373; 312/223.1; 220/735; 439/501, 577
See application file for complete search history.

(56) References Cited

U.S. PATENT DOCUMENTS

| | | | | | |
|---|---|---|---|---|---|
| D272,655 | S | | 2/1984 | Smith | |
| 4,724,791 | A | | 2/1988 | McSorley | |
| 4,875,878 | A | * | 10/1989 | Meyer | 439/501 |
| 5,064,067 | A | * | 11/1991 | McAllister et al. | 206/420 |
| 5,083,241 | A | * | 1/1992 | Foster | 362/33 |
| 5,124,903 | A | * | 6/1992 | Coviello | 362/392 |
| 5,215,280 | A | | 6/1993 | Tigrett | |
| 5,344,339 | A | * | 9/1994 | Cheslock | 439/501 |
| 5,485,931 | A | * | 1/1996 | Barr, Jr. | 211/70.6 |
| 5,593,316 | A | * | 1/1997 | Lyons | 439/501 |
| D383,439 | S | * | 9/1997 | Tremmel et al. | D13/137.3 |
| 5,848,701 | A | * | 12/1998 | Riccabona | 206/702 |
| 5,917,694 | A | * | 6/1999 | Denny | 361/643 |
| 6,035,800 | A | | 3/2000 | Clifford | |
| 6,065,981 | A | | 5/2000 | Sopotnick et al. | |
| 6,099,060 | A | * | 8/2000 | Towers | 294/159 |
| 6,164,582 | A | * | 12/2000 | Vara | 242/395 |
| 6,227,388 | B1 | * | 5/2001 | Borzelleca | 211/88.01 |
| 6,676,422 | B1 | | 1/2004 | Baker et al. | |
| 6,702,237 | B2 | * | 3/2004 | Rubenstein et al. | 248/68.1 |
| 6,844,494 | B1 | * | 1/2005 | Nevins | 174/53 |
| 7,172,456 | B1 | * | 2/2007 | Nagy | 439/501 |
| 7,189,106 | B2 | * | 3/2007 | Young | 439/501 |
| 7,198,511 | B2 | * | 4/2007 | Brennan, Jr. | 439/501 |
| 2004/0055978 | A1 | * | 3/2004 | Barnhart | 211/70.6 |
| 2005/0106935 | A1 | * | 5/2005 | Pena | 439/501 |
| 2005/0164545 | A1 | * | 7/2005 | Rosenthal et al. | 439/501 |
| 2005/0176290 | A1 | * | 8/2005 | Lichtscheidl et al. | 439/501 |
| 2006/0040548 | A1 | * | 2/2006 | Brennan | 439/501 |
| 2006/0141855 | A1 | * | 6/2006 | Bloom et al. | 439/501 |
| 2006/0264094 | A1 | * | 11/2006 | Young | 439/501 |

* cited by examiner

*Primary Examiner*—Jennifer E. Novosad
(74) *Attorney, Agent, or Firm*—Thomas, Kayden, Horstemeyer & Risley, LLP

(57) ABSTRACT

Included is a cord storage device. The cord storage device may include an exterior portion that is constructed of a non-conductive material. The cord storage device may also include at least one receiving surface on the exterior portion, the receiving surface configured to define a cord holding aperture. The cord holding aperture may include a cord insertion portion, the cord insertion portion constructed to receive a cord. The cord holding aperture may also include a cord storing portion constructed with at least one dimension being smaller than the cord insertion portion, the cord storing portion being configured to receive the cord from the cord insertion portion. The cord holding aperture may also include a cord locking portion that can be constructed with at least one dimension being smaller than the cord storing portion, the cord locking being configured to removably secure the cord in the cord storing portion.

18 Claims, 10 Drawing Sheets

ELECTRICAL CORD STORAGE SYSTEMS AND METHODS

TECHNICAL FIELD

The present disclosure relates to systems and methods for cord storage. More specifically, the present disclosure relates to storage of a marine electrical cord with an eye toward safety.

BACKGROUND

Similar to terrestrial vehicles, marine vehicles such as boats utilize gasoline or diesel fuel as well as electricity for power. Generally speaking most vehicles, whether they be terrestrial or marine, utilize a battery or a plurality of batteries for storing electrical charge. The stored electrical charge can be used for a variety of purposes, including but not limited to starting the engine and powering the gauges, lights, and even the radio. Terrestrial vehicles, such as automobiles generally utilize an alternator for recharging the battery or batteries. An alternator is a device that converts mechanical energy generated by the engine into electrical energy that is stored by the battery. The electrical energy can then be utilized as needed.

While a marine vessel generally operates in a similar manner to that of a terrestrial vehicle, there may be important differences. As a nonlimiting example, while a terrestrial vehicle will generally have one battery, a marine vessel may utilize a plurality of batteries. One battery may be designated exclusively for starting the engine, while another may accommodate the electric gauges, air conditioning, etc. As marine vessels will often consume an inordinate amount of energy during and after use, the alternator may often be unable to fully replenish the consumed electricity in the time the marine vessel is in use.

When a marine vessel is not in use, the battery may still be active. As a nonlimiting example, the marine vessel may include a pump to remove water the vessel has acquired. Using the pump for long periods may deplete the stored energy in the battery or batteries, such that the vessel becomes unable to start. Alternatively, depending on the type of battery being used, maintaining the battery charge at a low level may significantly reduce the battery life.

To solve this problem, many marine vessels may be able to connect with a power source for either recharging the batteries or providing power to the vessel while the engine is not running. Generally, this power source can include a 110-Volt, 30-Ampere source, or other power source, depending on the battery and use. The power source may be supplied to the vessel from an electrical outlet at a home or business. Extension cords may be utilized to bring that power to the vessel. The extension cords used in this manner may include a locking mechanism such that when connected to the vessel, there is a reduced risk of the cord becoming accidentally unplugged. As is evident, the use of electrical power sources around water can be dangerous. Safety measures such as the locking mechanism are essential to providing a safe environment for users of the vessel and the area where the vessel is located.

Although some safety measures are employed while the external power is supplied to the marine vessel, problems may occur when the vessel is in use, and not "plugged in" to the power source. Generally, the extension cord that is used to provide this external power is left near the water to be used when a vessel returns. As is evident, leaving an exposed power cord can provide a safety threat both in terms of possible electric shock or even electrocution, and as a physical obstacle to users of the vessel when entering or exiting the vessel.

Thus, a heretofore unaddressed need exists in the industry to address the aforementioned deficiencies and inadequacies.

SUMMARY

The present disclosure includes a cord storage device. The cord storage device typically includes an exterior portion that is constructed of a nonconductive material. The cord storage device may also include at least one receiving surface on the exterior portion, the receiving surface configured to define a cord holding aperture. The cord holding aperture may include a cord insertion portion. The cord insertion portion may be constructed to receive a cord. The cord holding aperture may also include a cord storing portion constructed with at least one dimension being smaller than the cord insertion portion. The cord storing portion may be configured to receive the cord from the cord insertion portion. The cord holding aperture may also include a cord locking portion that can be constructed with at least one dimension being smaller than the cord storing portion. The cord locking portion may be configured to removably secure the cord in the cord storing portion. The cord storage device may store any type of cord, including electrical cords for marine vessels. The cord storage device may be made of a water-resistant material. The cord storage device may be any appropriate color to denote safety, caution, or danger, such as but not limited to yellow or red.

Additionally included is a method for removably securing a cord in a cord storage device. The method includes inserting at least one end of the cord through a cord insertion portion of the cord storage device. Also included in the method is moving the cord from the cord insertion portion of the cord storage device to a cord storing portion of the cord storage device, wherein the cord storing portion of the cord storage device is configured to removably secure at least a portion of the cord.

Other systems, methods, features and/or advantages will be or may become apparent to one with skill in the art upon examination of the following drawings and detailed description. It is intended that all such additional systems, methods, features, and/or advantages be included within the scope of the present invention and be protected by the accompanying claims.

BRIEF DESCRIPTION OF THE DRAWINGS

The components in the drawings are not necessarily to scale relative to each other. Like reference numerals designate corresponding parts throughout the several views.

DETAILED DESCRIPTION

Figure 1:
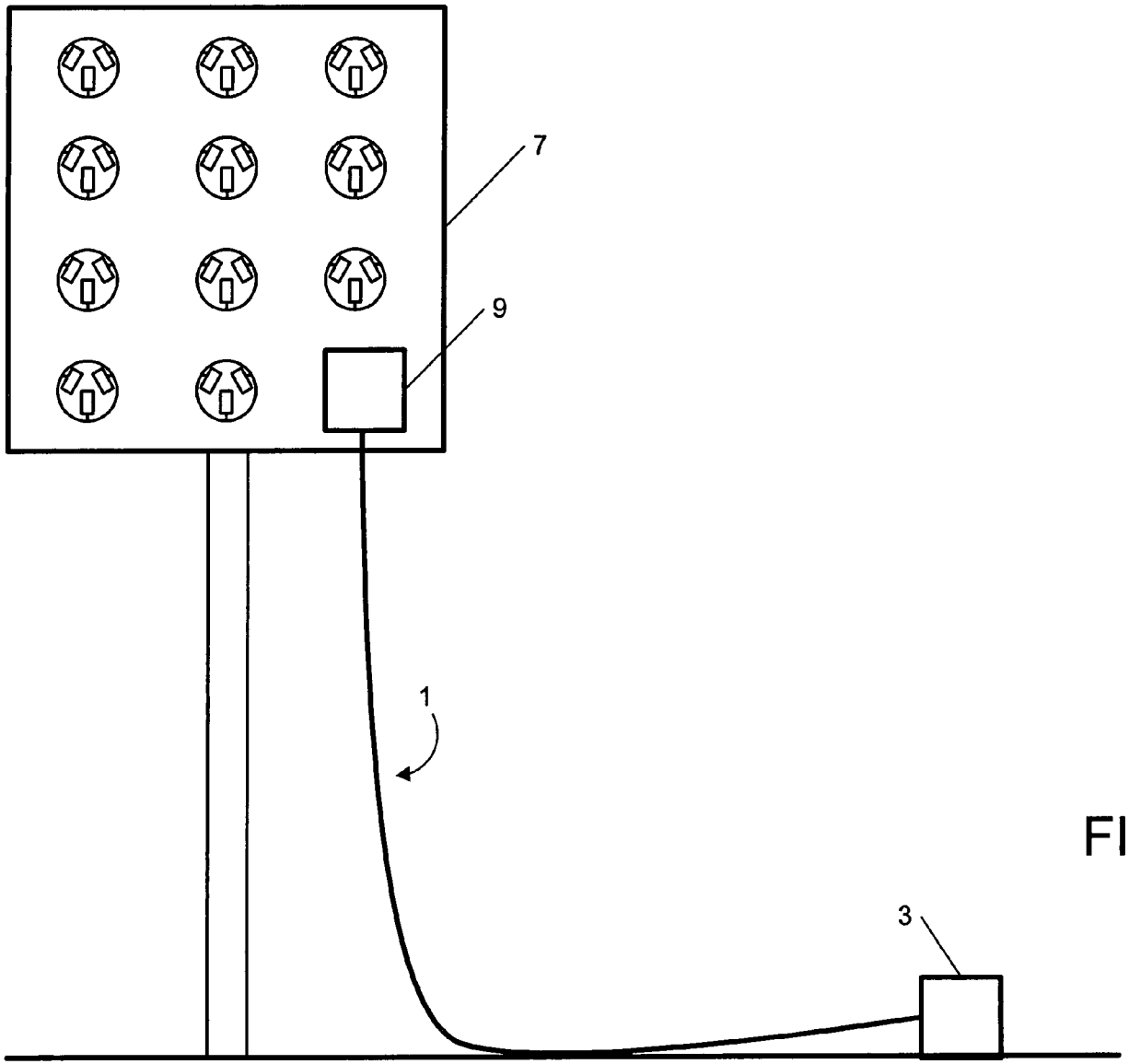
FIG. 1 is a block diagram of an electric power source with electric cable attached.

Many aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views. While several embodiments are described in connection with these drawings, there is no intent to limit the disclosure to the embodiment or embodiments disclosed herein. On the contrary, the intent is to cover all alternatives, modifications, and equivalents.

FIG. 1 is a block diagram of an electric power source with electric cable attached. As illustrated in FIG. 1, electric cord 1 is connected to electric power source 7 via the male end 9 of electric cord 1. A female end 3 of electric cord 1 is resting on the ground. As is evident the male end 9 of electrical cord 1 includes a plurality of conductive prongs for insertion into an electrical socket. The female end 3 of electrical cord 1 includes a plurality of apertures configured to receive conductive prongs from another electrical cord, a battery, or other electrical destination.

Figure 2:
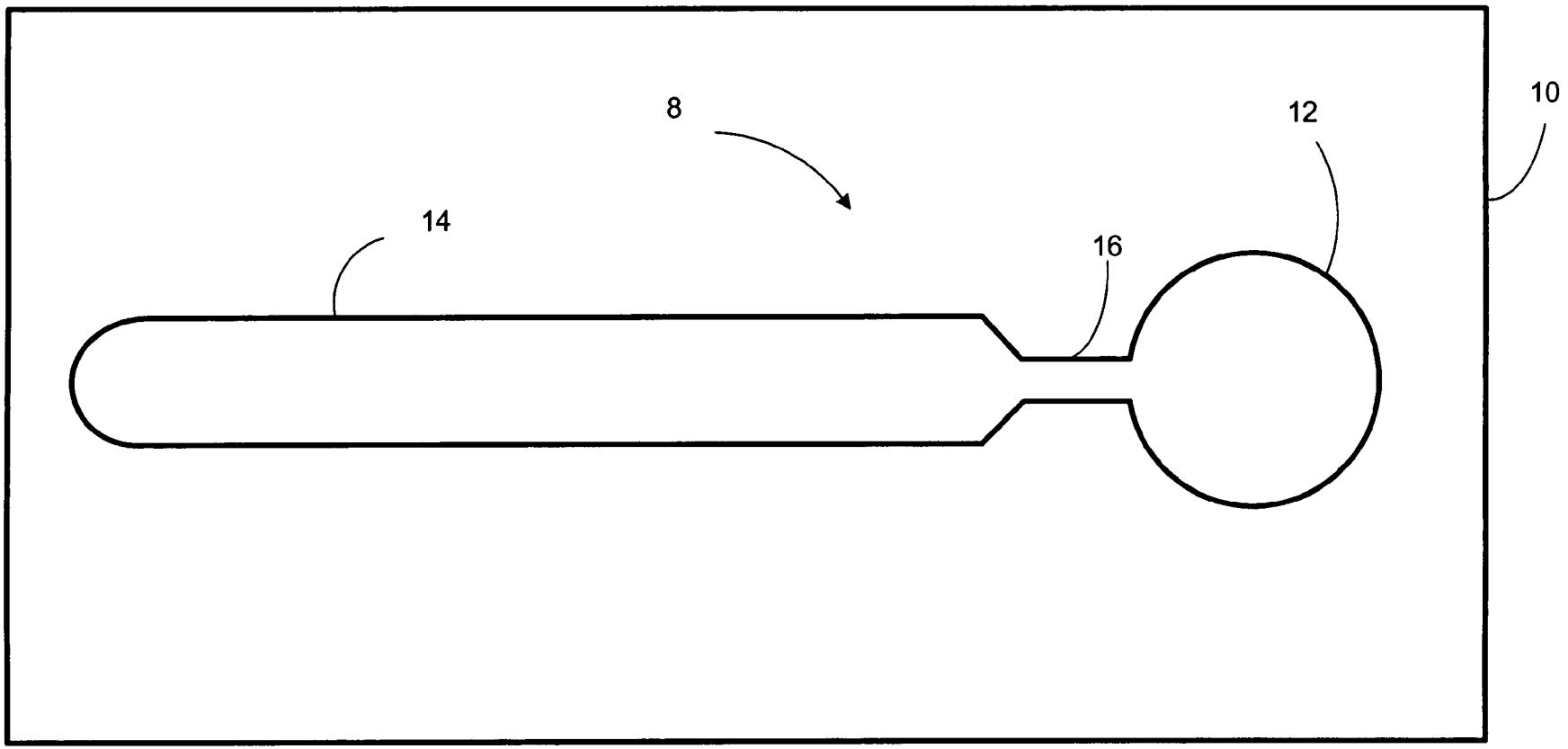
FIG. 2 is a bottom view two-dimensional schematic of one embodiment of the cord storage device.

FIG. 2 is a bottom view two-dimensional schematic of one embodiment of the cord storage device. As illustrated in FIG. 2, a bottom view cord storage device 10 is illustrated as a rectangular receiving surface that defines an elongated cord holding aperture 8. The cord holding aperture 8 includes a cord insertion portion 12, a cord storing portion 14 and a cord locking portion 16. In one embodiment, the cord insertion portion 12 is a circular aperture large enough to receive the female end 3 or male end 9 of electrical cord 1 of FIG. 1. Depending on the type of cord to be stored, the cord insertion portion 12 may vary in size and shape, and is not limited to a circular configuration as shown in FIG. 2.

Also included in the cord holding aperture 8 is a cord storing portion 14. The cord storing portion 14 can be an elongated aperture configured to hold the male end 9 or the female end 10 of the electrical cord 1 (or both) within the cord storage device 10. The width of cord storing portion 14 can be configured to be larger than the diameter of the body 1 of electrical cord 2, but smaller than the head 3 of the electrical cord 2 (see FIG. 4). Such a configuration allows for the cord storing portion 14 to receive the body 1 of electrical cord 2, while securing the electrical cord 2 in place by not allowing the head 3 of electrical cord 2 to fall through the cord storing portion 14.

Coupled to both the cord storage portion 14 and the cord insertion portion 12 is a cord locking portion 16. The cord locking portion 16 is configured to prevent the electrical cord 1 from accidentally falling back through cord insertion portion 12 when the cord storage device 10 is in use. As shown in FIG. 2, the cord locking portion 16 is narrower than cord storing portion 14. By designing the cord locking portion 16 in a narrower configuration than cord storing portion 14, the electrical cord 1 will likely remain in cord storing portion 14 when in use. While the embodiment illustrated in FIG. 2 shows a tapered transition from the cord storing portion 14 to the cord locking portion 16, this is but one nonlimiting example.

Figure 3:
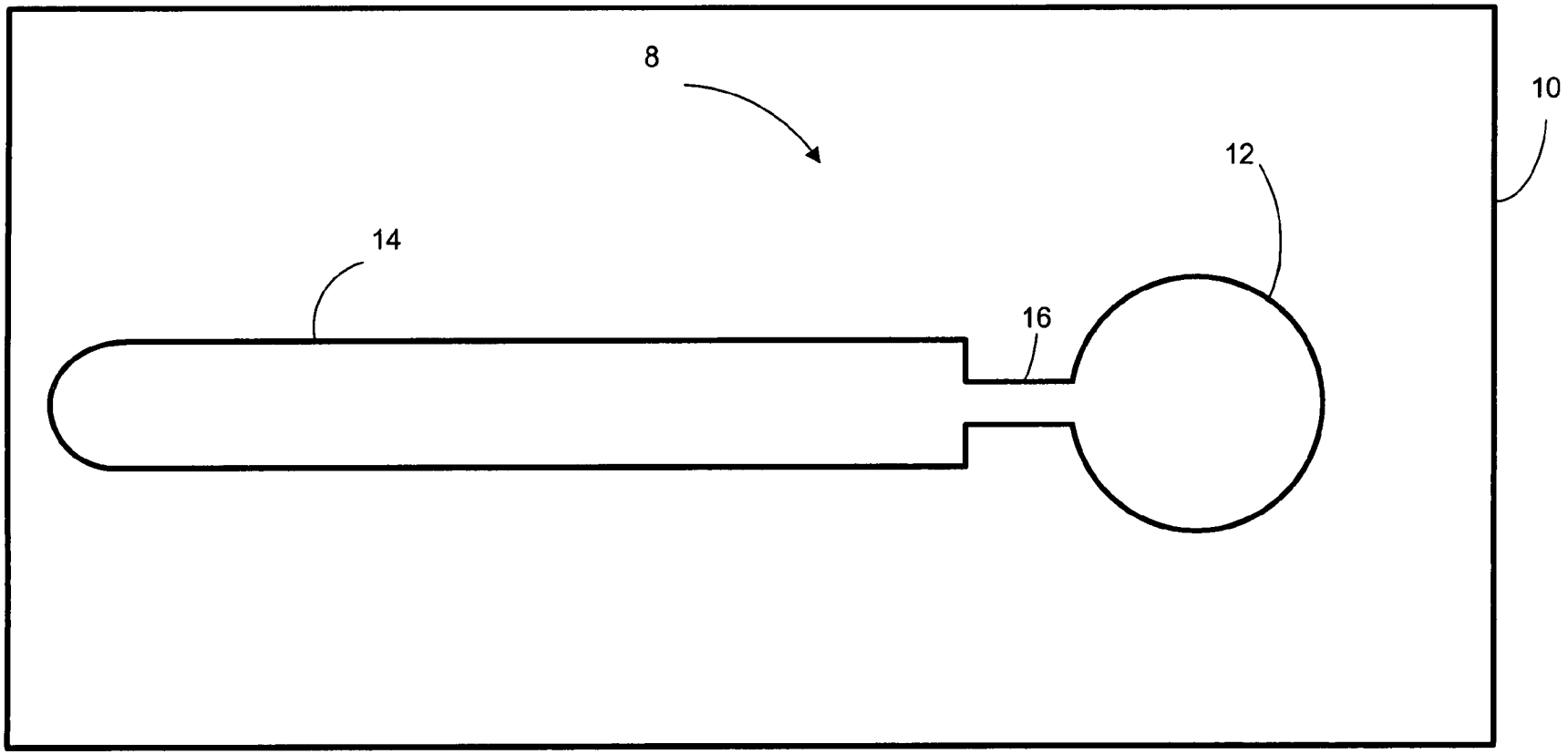
FIG. 3 is an alternative bottom view two-dimensional schematic of the cord storage device from FIG. 2.

FIG. 3 is an alternative bottom view two-dimensional schematic of the cord storage device from FIG. 2. Similar to FIG. 2, this nonlimiting example illustrates a receiving surface that defines a cord holding aperture 8. The cord holding aperture includes a cord insertion portion 12, a cord storing portion 14 and a cord locking portion 16. However, unlike FIG. 2, in FIG. 3 the transition from the cord storing portion to the cord locking portion is not tapered. As is evident, there are many alternative variations that may be implemented to achieve a desired result.

Figure 4:
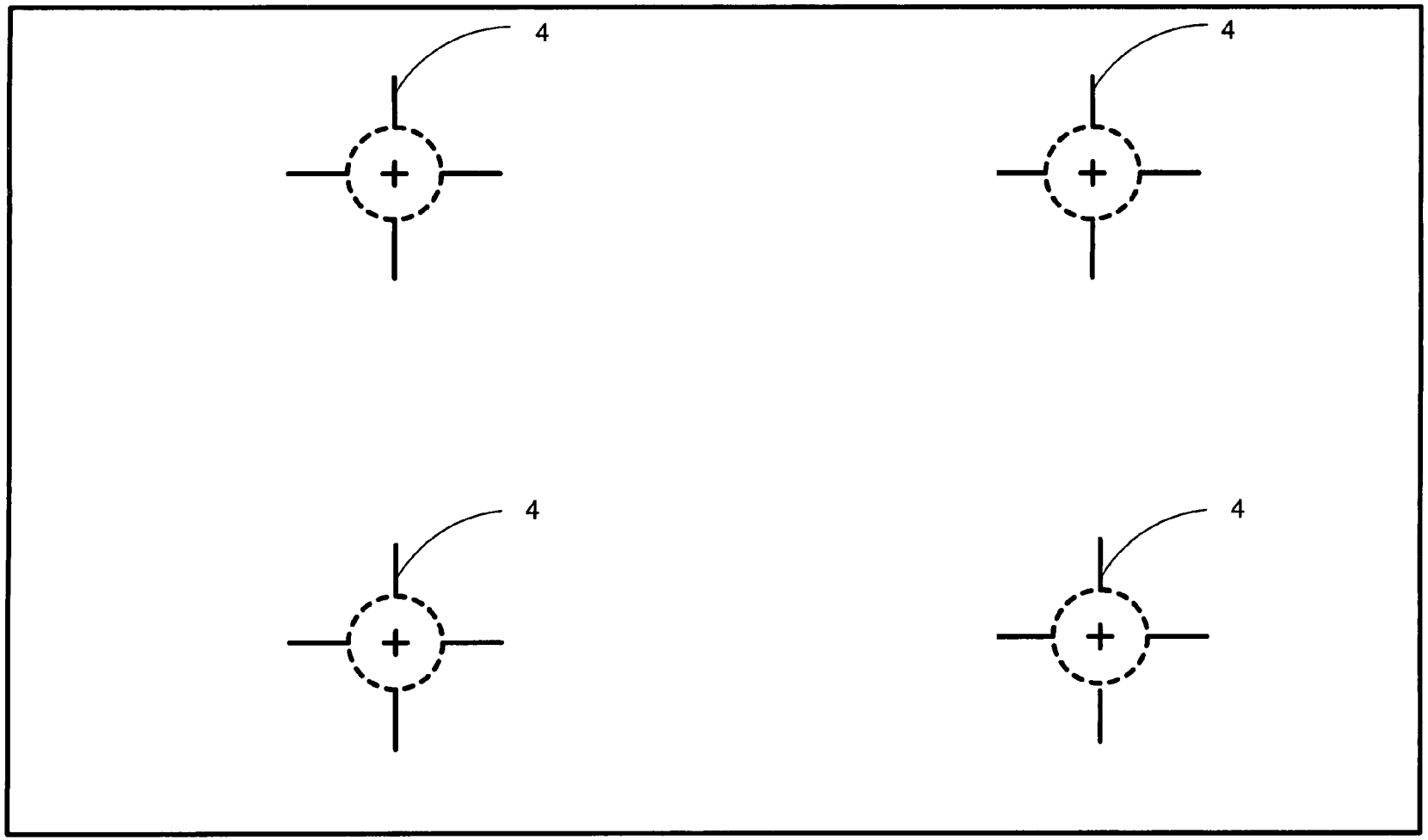
FIG. 4 is a back view two-dimensional schematic of one embodiment of the cord storage device, adjacent to the schematic of FIGS. 2 and 3.

FIG. 4 is a back view two-dimensional schematic of one embodiment of the cord storage device. As illustrated in FIG. 4, supports 4 may be implemented to secure the cord storage device 10 to an object such as a dock, a wall, a pier, or other suitable object. While FIG. 4 illustrates supports 4 as apertures, as is evident the cord storage device 10 may be supported in any of a variety of ways including Velcro®, snaps, tape, glue, or any other conceivable support. Additionally, cord storage device 10 may be designed such that a user can easily create supports 4 by piercing the exterior material of the cord storage device 10. Further, while FIG. 4 illustrates that there are four supports 4, this is but a nonlimiting example as any number of supports may be used. Finally, while supports 4 are illustrated on the back view diagram of FIG. 4, the present disclosure is not limited to such an embodiment. Any surface of cord storage device 10 may be utilized for supports 4.

Figure 5:
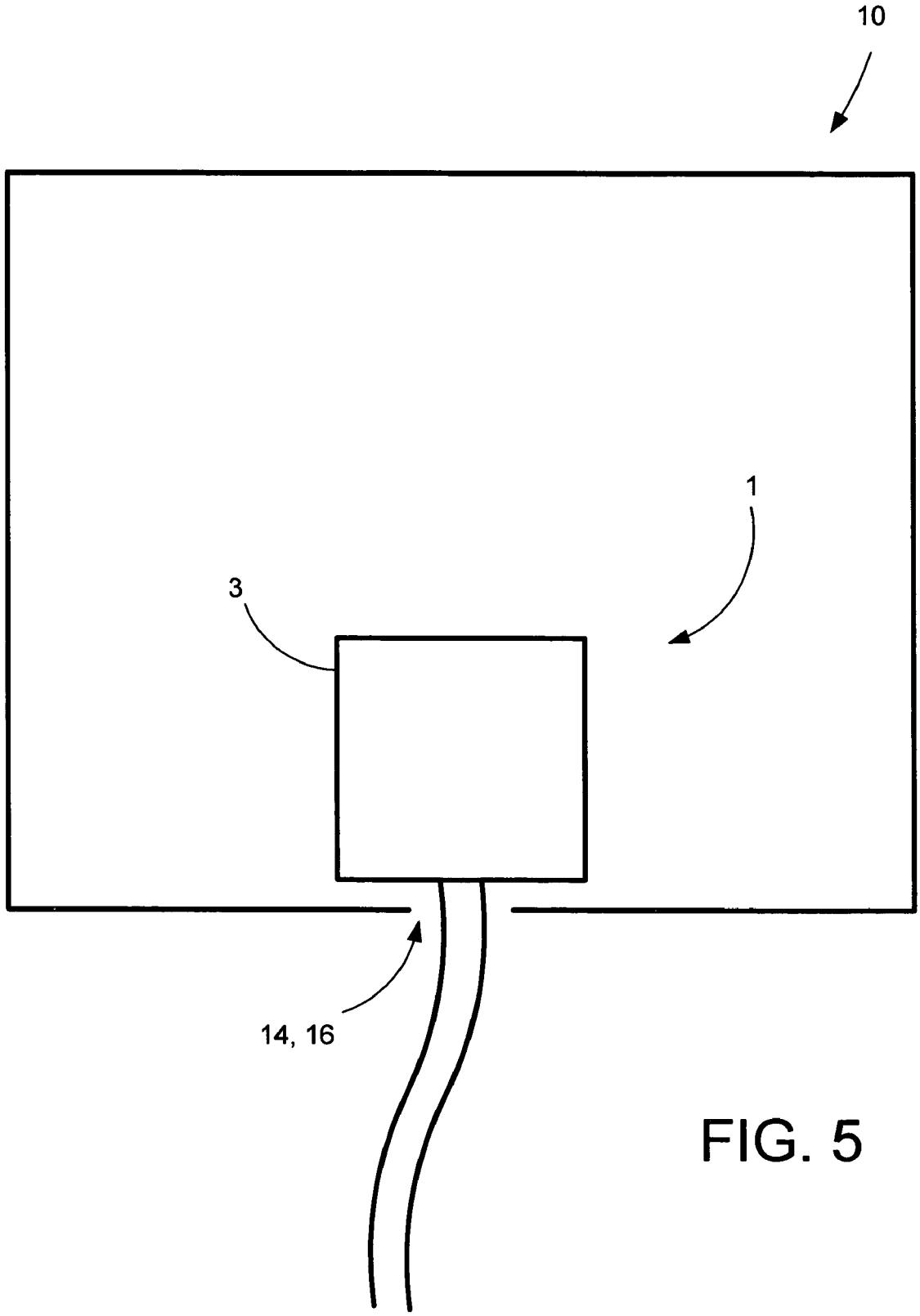
FIG. 5 is a side view two-dimensional schematic of one embodiment of the cord storage device, adjacent to the schematic of FIGS. 2 and 3.

FIG. 5 is a side view two-dimensional schematic of one embodiment of the cord storage device 10. As illustrated in FIG. 5, the female end 3 of electrical cord 1 is residing within the cord holding aperture 8 (FIGS. 2 and 3) in the cord storage device 10. FIG. 5 illustrates that the cord holding aperture 8 is designed such that the head 3 of electrical cord 1 is larger than the cord storing portion 14 and the cord locking portion 16 to secure the electrical cord 1 within the cord storage device 10.

Figure 6:
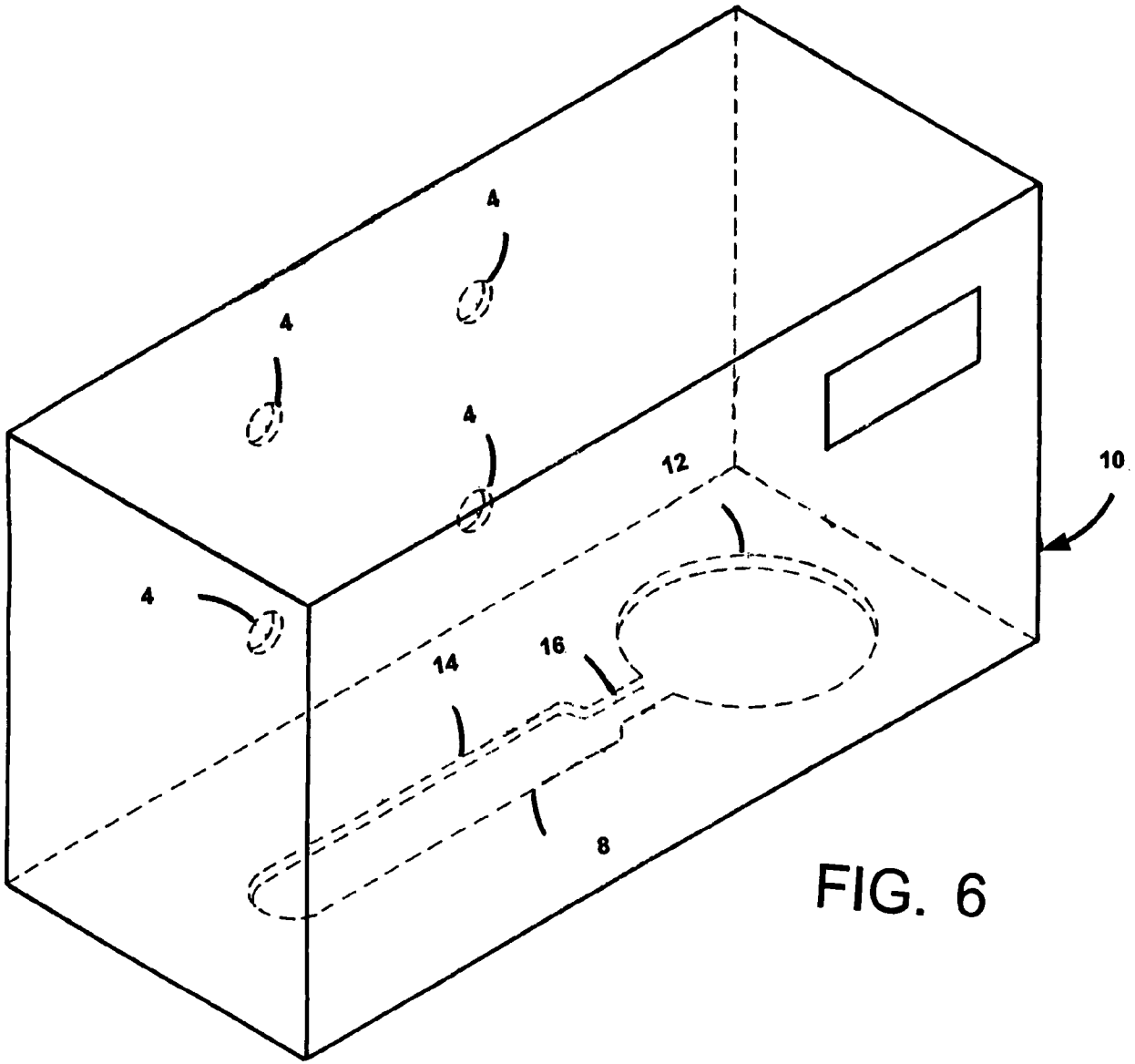
FIG. 6 is a three-dimensional schematic view of one embodiment of the cord storage device of FIGS. 2-5.

FIG. 6 is a three-dimensional schematic view of one embodiment of the cord storage device 10 from FIGS. 2-5. As illustrated in FIG. 6, the cord storage device 10 may be configured in a substantially rectangular configuration. While FIG. 6 illustrates a generally rectangular configuration, as is evident, cord storage device 10 may be configured in any shape including, but not limited to both regular and irregular shapes. Additionally, the cord storage device 10 may be designed to store any number of cords.

Further, the cord storage device 10 may be constructed using any suitable nonconductive material, including, but not limited to wood, plastic, rubber, bake-a-lite or other nonconductive material that can provide at least some protection from electrical shock. Further, at least a portion of cord storage device 10 can be constructed of a water resistant material to provide at least some protection from splash. Additionally, the color of the cord storage device can be selected to indicate a potential proximate electrical hazard (e.g., red or yellow to indicate safety, caution, or danger).

Additionally, while the present disclosure discusses the cord storage device 10 with respect to electrical cords, this is but a nonlimiting example of one embodiment. As is evident, the cord storage device 10 can be designed and used for any type of cord, hose, wire, conduit, or similar material.

Figure 7:
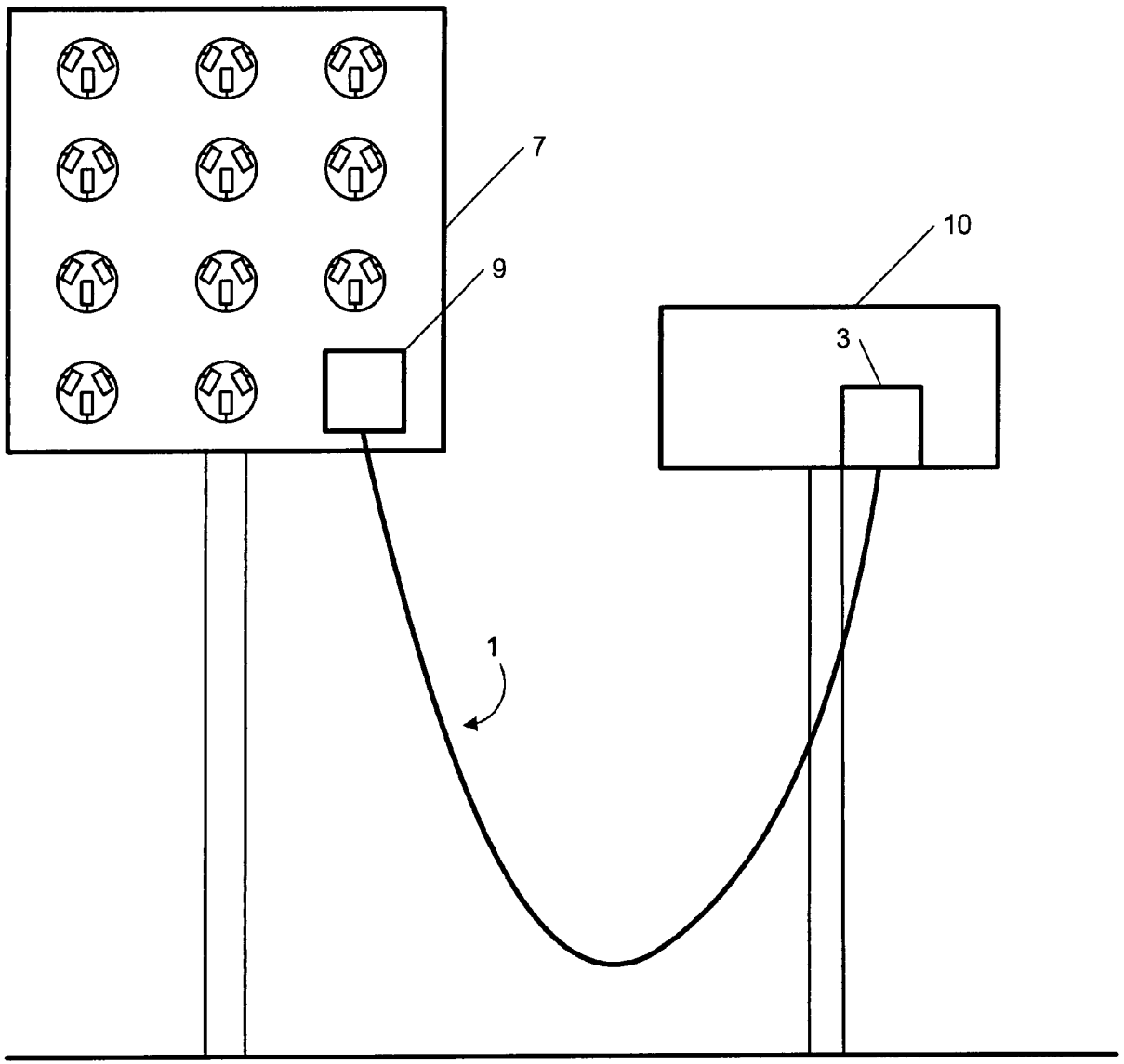
FIG. 7 is a functional block diagram of the electric power source from FIG. 1 with electrical cord attached, and implementing one embodiment of the present disclosure.

FIG. 7 is a block diagram of the electric power source 7 from FIG. 1 with electrical cord 1 attached, and implementing one embodiment of the present disclosure. As illustrated in FIG. 7, the male end 9 of electrical cord 1 is connected to electric power source 7, and the female end 3 of the electrical cord 1 is secured in cord storage device 10. In this configuration, the electrical cord 1 is protected from splash and stored in a safe area. Additionally, with power cord 1 residing within cord storage device 10, the risk of electric shock is reduced.

Figure 8:
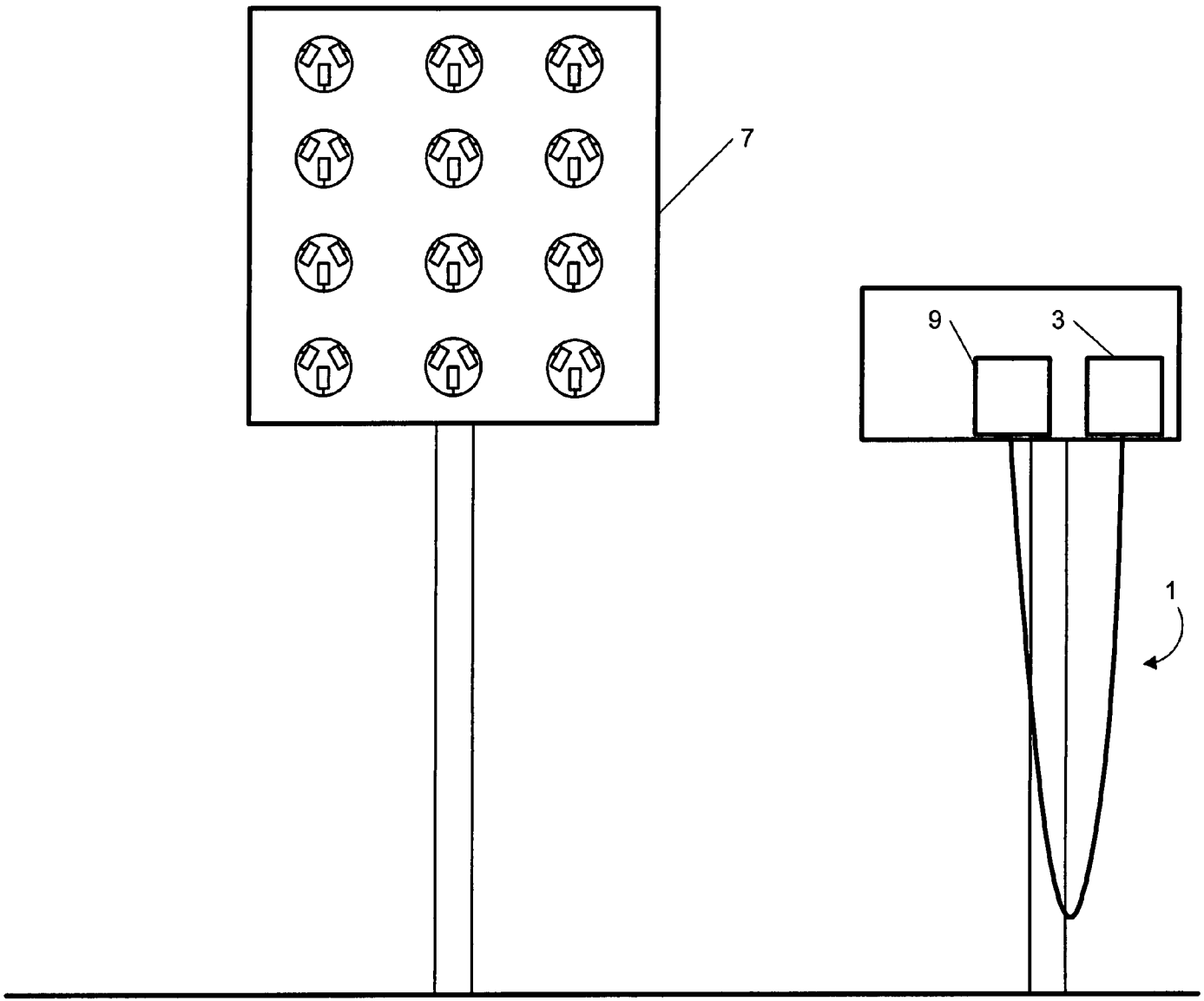
FIG. 8 is a functional block diagram of the electric power source from FIG. 1 with electrical cord attached, and implementing another embodiment of the present disclosure.

FIG. 8 is a functional block diagram of the electric power source from FIG. 1 with electrical cord attached, and implementing another embodiment of the present disclosure. As illustrated in FIG. 8, the male end 9 of electrical cord 1 has been removed from electric power source 7. In this representation, both the male end 9 and the female end 3 of the electric cord 1 reside within cord storage device 10. As is evident, the electric cord 1 is no longer "live," but cord storage device 10 prevents damage to the electric cord 1 by removing the electric cord 1 from foot traffic, as well as protecting the electric cord 1 from splash.

Figure 9:
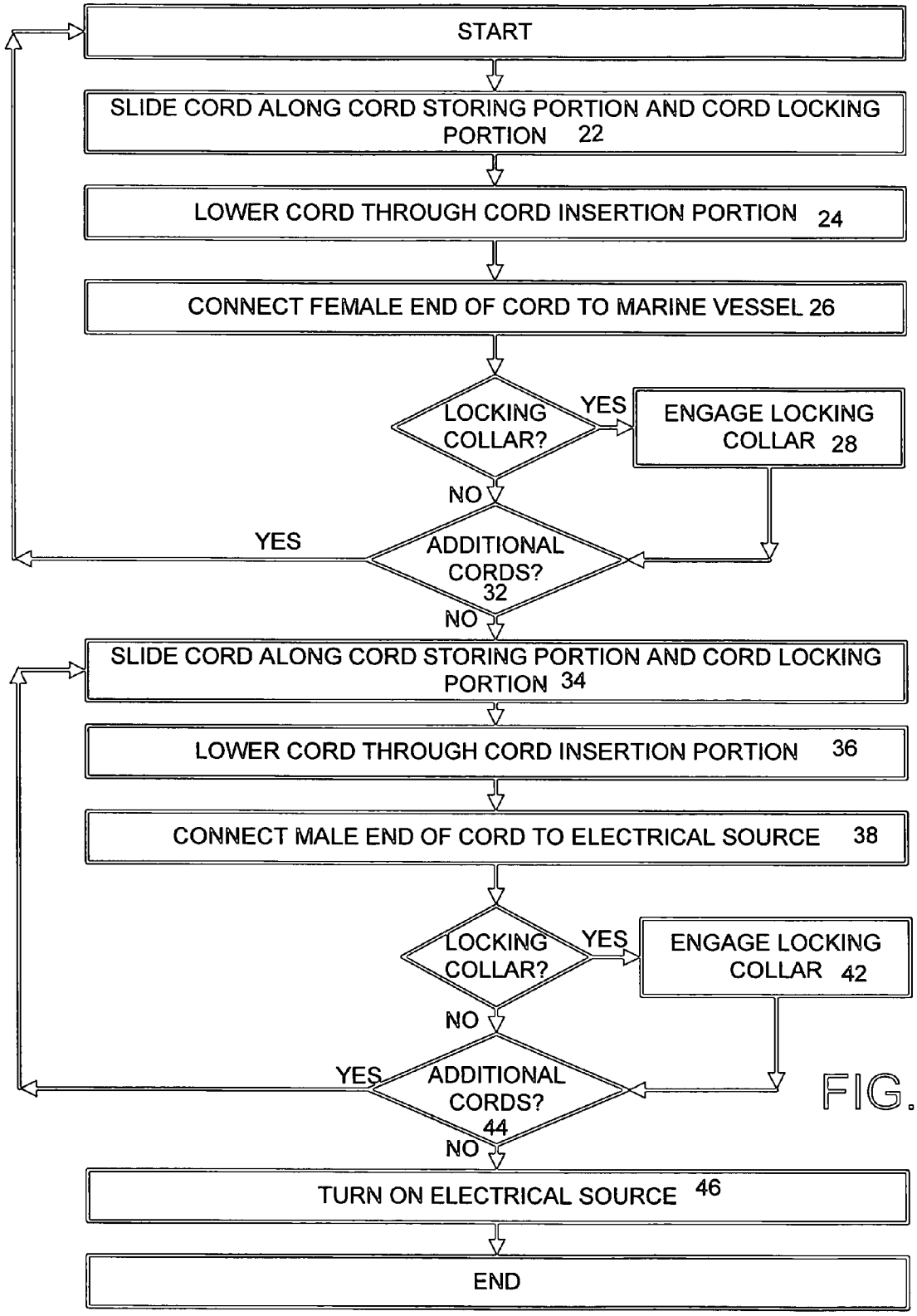
FIG. 9 is a flow chart illustrating one embodiment of operating the cord storage device pursuant to a configuration similar to the configuration represented in FIG. 8.

FIG. 9 is a flow chart illustrating one embodiment of operating the cord storage device pursuant to a configuration similar to the configuration represented in FIG. 8. In use, when a user wishes to connect an electrical cord to a marine vessel, he or she can remove the female end 3 of the electric cord 1 from the cord storage device by sliding the cord from the cord storing portion 14 along the cord locking position 16 to the cord insertion portion 12 of the cord holding aperture 8 (step 22). Then, the user can lower the electrical cord 1 through the cord insertion portion 12 (step 24). The female end of the electrical cord 1 may then be connected to the marine vessel (step 26). If applicable, a locking collar may be engaged to lock the electrical cord 2 to the marine vessel (step 28). If additional electrical cords are desired, similar procedures may also be implemented (step 32).

The user can then remove the male end 9 of the electrical cord 1 from the cord storage device 10 by sliding the electrical cord 1 along the cord storing portion 14 along the cord locking portion 16 to the cord insertion portion 12 of the cord holding aperture 8 (step 34). The user can lower the electrical cord 1 through the cord insertion portion (step 36). Once the male end 9 of the electrical cord 1 is removed from the cord storage device 10, the male end 9 may be connected to the electrical power source 7 (step 38). If applicable, a locking collar may be engaged to lock the electrical cord 1 to the electrical power source 7 (step 42). The user can repeat these steps for additional electrical cords (step 44). Once all desired electrical cords are correctly connected, the user may turn on the electrical source via an on/off switch or electrical circuit breaker (step 46).

Figure 10:
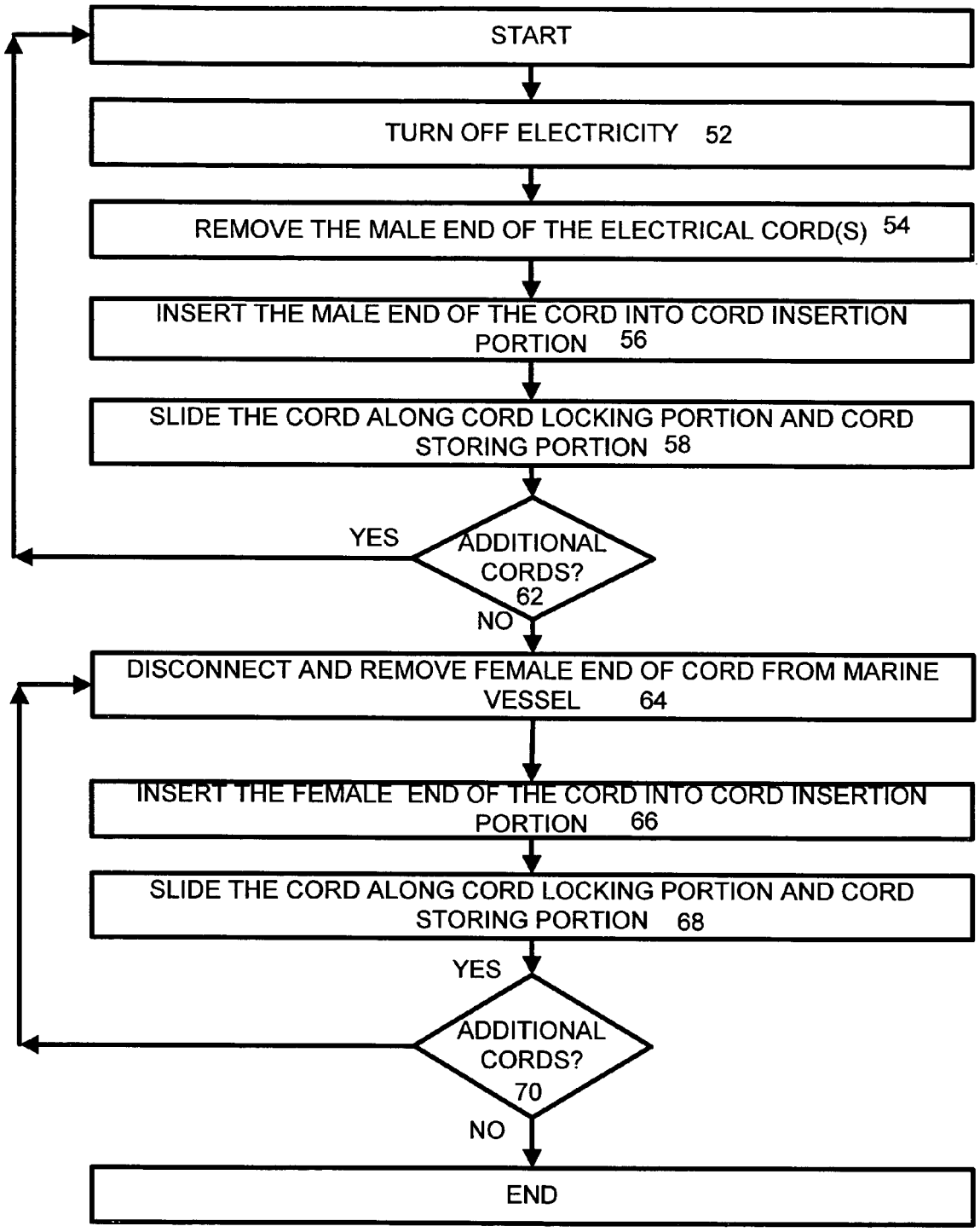
FIG. 10 is a flow chart illustration of another embodiment of operating cord configured in a manner similar to the configuration illustrated in FIG. 8.

FIG. 10 is a flow chart illustration of another embodiment of operating cord configured in a manner similar to the configuration illustrated in FIG. 8. After use of the external power is no longer desired, the user may disconnect the electric cord 1 from the electrical power source by turning the electricity off via an on/off switch or electrical breaker (step 52) and removing the male end 9 of the electrical cord(s) 1 from the electrical power source 7 (step 54). The user can hold the male end 9 of the electrical cord 1 in an upright position under the cord storage device. The user can insert the male end 9 of the electrical cord 1 into the cord insertion portion 12 of the cord storage device 10 (step 56), and slide the electrical cord 1 along the cord locking portion 16 and the cord storing portion 14 of the cord holding aperture 8 (step 58). The user can check for additional cords and repeat the above steps, if necessary (step 62).

The user can then disconnect and remove the female end 3 of the electrical cord(s) 1 from the marine vessel (step 64). The user can do this by holding the female end 3 of the electrical cord 1 in an upright position under the cord storage device 10. The user inserts the female end 3 of the electrical cord 1 into the cord insertion portion 12 of the cord holding aperture 8 (step 66), and slides the electrical cord 1 along the cord locking portion 16 into the cord storing portion 14 (step 68). The user can then check for additional cords (step 70). If there are additional cords, the user may return to step 64. Otherwise the process is complete.

As shown, FIG. 9 illustrates that the female end 3 of the cord 1 is connected first. Similarly, in FIG. 10 the male end 9 of the electrical cord 1 is removed first. As is evident, this process can be reversed. Similarly, any variation of the steps disclosed herein are considered part of the present disclosure.

It should be emphasized that many variations and modifications may be made to the above-described embodiments. All such modifications and variations are intended to be included herein within the scope of this disclosure and protected by the following claims.

The invention claimed is:

1. A cord storage device for storing a standard 30 Ampere extension cord, where the standard 30 Ampere extension cord has a cord width, the cord including a male end and a female end, the male end having a male width and the female end having a female width, the cord storage device comprising:

a securing surface, the securing surface including at least one securing aperture configured to secure the cord storage device to an object; and a receiving surface coupled to the securing surface, the receiving surface comprising:

a cord insertion portion disposed on the receiving surface of the cord storage device, the cord insertion portion being an aperture with substantially circular shape having a receiving width larger than the male width and the female width, the cord insertion portion configured to receive at least one of the following: the male end of the cord and the female end of the cord;

a cord storing portion disposed on the receiving surface, the cord storing portion coupled to the cord insertion portion, the cord storing portion configured as an elongated aperture, the cord storing portion having a storing width smaller than the male width of the cord and the female width of the cord, larger than the cord width, and smaller than the receiving width the cord storing portion configured to receive, from the cord insertion portion, at least one of the following: the male end of the cord and the female end of the cord; and a cord locking portion disposed on the receiving surface, the cord locking portion defining an aperture coupled to the cord storing portion and coupling the cord storing portion to the cord insertion portion, the cord locking portion having a locking width smaller than the storing width, the cord locking portion configured to removably secure at least one of the following: the male end of the cord and the female end of the cord, wherein the cord storage device includes a plurality of surfaces, including the receiving surface and the securing surface, that enclose an area for storing at least one of the following: the male end of the cord and the female end of the cord, when removably secured via the cord locking portion, wherein the cord storage device is configured to secure the cord such that at least a portion of the cord resides outside the enclosed area and at least one of the following resides within the enclosed area: the male end of the cord and the female end of the cord.

2. The cord storage device of claim 1, wherein the cord storage device is configured to store at least one cord used by watercrafts for performing at least one of the following: charging electrical components and operating electrical components.

3. The cord storage device of claim 1, wherein at least a portion of the cord storage device is constructed of a water-resistant material.

4. The cord storage device of claim 1, wherein at least one of the surfaces is constructed with a non-conductive material.

5. The cord storage device of claim 1, wherein at least one of the surfaces is constructed with a material that includes at least one of the following: wood, plastic, rubber, and bake-a-lite.

6. The cord storage device of claim 1, wherein at least a portion of the cord storage device is marked to identify an electrical hazard.

7. The cord storage device of claim 1, wherein the cord storage device is substantially rectangular.

8. The cord storage device of claim 1, wherein the object includes at least one of the following: a dock, a wall, a pier, and a boat mooring.

9. The cord storage device of claim 1, further comprising the 30 Ampere cord.

10. The cord storage device of claim 1, wherein the area enclosed by the cord storage device is rectangular in shape.

11. The cord storage device of claim 1, wherein the cord storage device is configured to secure the cord such that at least a portion of the cord resides outside the enclosed area and at least one of the following resides within the enclosed area: the male end of the cord and the female end of the cord.

12. The cord storage device of claim 1, wherein when the cord storage device is secured to an object, the receiving surface is oriented as a bottom surface of the cord storage device, such that when at least one of the male end and the female end are being stored within the enclosed area of the cord storage device, the a cord portion of the 30 Ampere cord hangs below the area enclosed by the cord storage device.

13. The cord storage device of claim 1, wherein the apertures of the cord storage device include only the apertures defined by the cord insertion portion, the cord storing portion, and the cord locking portion, such that the area enclosed by the cord storage device is fully enclosed, at areas not defined by the apertures.

14. The cord storage device of claim 1, wherein the cord storage device includes only one cord insertion portion, only one cord storing portion, and only one cord locking portion.

15. A cord storage device for storing a standard 50 Ampere cord, where the standard 50 Ampere cord has a cord width, the cord including a male end and a female end, the male end having a male width and the female end having a female width, the cord storage device comprising:

a 50 Ampere cord, the 50 Ampere cord including a cord portion a male end and a female end, the male end having a male width and the female end having a female width;

a securing surface, the securing surface including at least one securing aperture configured to secure the cord storage device to an object; and a receiving surface coupled to securing surface, the receiving surface comprising:

a cord insertion portion disposed on the receiving surface of the cord storage device, the cord insertion portion being an aperture with substantially circular shape having a receiving width larger than the male width and the female width, the cord insertion portion receiving at least one of the following: the male end of the cord and the female end of the cord;

a cord storing portion disposed on the receiving surface, the cord storing portion coupled to the cord insertion portion, the cord storing portion configured as an elongated aperture, the cord storing portion having a storing width smaller than the male width of the cord and the female width of the cord, larger than the cord width, and smaller than the receiving width the cord storing portion receiving, from the cord insertion portion, at least one of the following: the male end of the cord and the female end of the cord; and a cord locking portion disposed on the receiving surface, the cord locking portion defining an aperture coupled to the cord storing portion and coupling the cord storing portion to the cord insertion portion, the cord locking portion having a locking width smaller than the storing width, the cord locking portion configured to removably secure at least one of the following: the male end of the cord and the female end of the cord, wherein the cord storage device includes a plurality of surfaces, including the receiving surface and the securing surface, that enclose an area for storing at least one of the following: the male end of the cord and the female end of the cord, when removably secured via the cord locking portion, wherein the area enclosed by the cord storage device is rectangular in shape, wherein the cord storage device is configured to secure the cord such that at least a portion of the cord resides outside the enclosed area and at least one of the following resides within the enclosed area: the male end of the cord and the female end of the cord, wherein when the cord storage device is secured to an object, the receiving surface is oriented as a bottom surface of the cord storage device, such that when at least one of the male end and the female end are being stored within the enclosed area of the cord storage device, the cord portion of the 50 Ampere cord hangs below the area enclosed by the cord storage device, and wherein the apertures of the cord storage device include only the apertures defined by the cord insertion portion, the cord storing portion, and the cord locking portion, such that the area enclosed by the cord storage device is fully enclosed, at areas not defined by the apertures.

16. The cord storage device of claim 15, wherein the cord storage device includes only one cord insertion portion, only one cord storing portion, and only one cord locking portion.

17. A cord storage device for storing a standard 30 Ampere cord, where the standard 30 Ampere cord has a cord width, the cord including a male end and a female end, the male end having a male width and the female end having a female width, the cord storage device comprising:

a securing surface, the securing surface including at least one securing aperture configured to secure the cord storage device to an object; and a receiving surface coupled to securing surface, the receiving surface comprising:

a cord insertion portion disposed on the receiving surface of the cord storage device, the cord insertion portion being an aperture with substantially circular shape having a receiving width larger than the male width and the female width, the cord insertion portion configured to receive at least one of the following: the male end of the cord and the female end of the cord;

a cord storing portion disposed on the receiving surface, the cord storing portion coupled to the cord insertion portion, the cord storing portion configured as an elongated aperture, the cord storing portion having a storing width smaller than the male width of the cord and the female width of the cord, larger than the cord width, and smaller than the receiving width, the cord storing portion configured to receive, from the cord insertion portion, at least one of the following: the male end of the cord and the female end of the cord; and a cord locking portion disposed on the receiving surface, the cord locking portion defining an aperture coupled to the cord storing portion and coupling the cord storing portion to the cord insertion portion, the cord locking portion having a locking width smaller than the storing width, the cord locking portion configured to removably secure at least one of the following: the male end of the cord and the female end of the cord, wherein the area enclosed by the cord storage device is rectangular in shape, wherein the cord storage device includes a plurality of surfaces, including the receiving surface and the securing surface, that enclose an area for storing at least one of the following: the male end of the cord and the female end of the cord, when removably secured via the cord locking portion, wherein the cord storage device is configured to secure the cord such that at least a portion of the cord resides outside the enclosed area and at least one of the following resides within the enclosed area: the male end of the cord and the female end of the cord, wherein when the cord storage device is secured to an object, the receiving surface is oriented as a bottom surface of the cord storage device, such that when at least one of the male end and the female end are being stored within the enclosed area of the cord storage device, a cord portion of the 30 Ampere cord hangs below the area enclosed by the cord storage device, wherein the apertures of the cord storage device include only the apertures defined by the cord insertion portion, the cord storing portion, and the cord locking portion, such that the area enclosed by the cord storage device is fully enclosed, at areas not defined by the apertures, and wherein the cord storage device includes only one cord insertion portion, only one cord storing portion, and only one cord locking portion.

18. The cord storage device of claim 17, further comprising the standard 30 Ampere cord.

* * * * *